US005661989A

United States Patent [19]

Jeon et al.

[11] Patent Number: 5,661,989

[45] Date of Patent: Sep. 2, 1997

[54] WASHING MACHINE HAVING VERTICAL WATER GUIDING CHANNELS ON INNER SURFACE OF WASHING BASKET

[75] Inventors: Yong Byeong Jeon; Hyeong Reol Lee, both of Suwon, Rep. of Korea

[73] Assignee: Samsung Electronics Co., Ltd., Suwon, Rep. of Korea

[21] Appl. No.: 620,349

[22] Filed: Mar. 22, 1996

[30] Foreign Application Priority Data

Mar. 23, 1995 [KR] Rep. of Korea ..... 95-5212

[51] Int. Cl.[6] ..... D06F 39/10

[52] U.S. Cl. ..... 68/18 F; 68/23.5; 68/23.7; 68/207

[58] Field of Search ..... 68/23.3, 23.1, 68/23.5, 23.7, 207, 18 F

[56] References Cited

U.S. PATENT DOCUMENTS

| | | | |
|---|---|---|---|
| 1,832,560 | 11/1931 | Kendig | 68/23.5 |
| 2,270,750 | 1/1942 | Bariffi | 68/18 F |
| 2,278,911 | 4/1942 | Breckenridge | 68/12.24 |
| 3,195,327 | 7/1965 | Cobb | 68/12.24 |
| 5,509,283 | 4/1996 | Lee et al. . | |

FOREIGN PATENT DOCUMENTS

| | | | |
|---|---|---|---|
| 54-19563 | 2/1979 | Japan | 68/23.3 |
| 60-53186 | 3/1985 | Japan | 68/23.2 |
| 60-142897 | 7/1985 | Japan | 68/23.2 |
| 64-27591 | 1/1989 | Japan | 68/12.06 |
| 3-133497 | 6/1991 | Japan | 68/23.1 |
| 3-168196 | 7/1991 | Japan | 68/23.1 |

*Primary Examiner*—Frankie L. Stinson

*Attorney, Agent, or Firm*—Burns, Doane, Swecker & Mathis, L.L.P.

[57] ABSTRACT

An automatic clothes washing machine comprises a water container, a washing basket mounted inside the water container to rotate about a vertical axis, and an agitator having a plurality of radial vanes for rotating about the vertical axis to radially propel the water into vertical channels arranged on the inside of the side wall of the washing basket. The channels discharge the propelled water vertically along the side wall. Each vertical channel has a water inlet at the lower end, for receiving radially propelled water, and a plurality of vertically spaced water outlets for discharging the water back into the washing basket. At least one of the water outlets is disposed below a vertical center of its respective channel, and a filter is mounted at the lowest water outlet.

6 Claims, 3 Drawing Sheets

WASHING MACHINE HAVING VERTICAL WATER GUIDING CHANNELS ON INNER SURFACE OF WASHING BASKET

RELATED INVENTION

This invention is related to that disclosed in U.S. Pat. No. 5,509,283, issued Apr. 23, 1996.

BACKGROUND OF THE INVENTION

The present invention concerns a washing machine, which comprises a water container enclosed in a housing for containing water, a washing basket mounted inside the water container to rotate about a vertical axis, an agitator for rotating about the vertical axis to radially expel the water, a guide channel arranged on the inside of the side wall of the washing basket for upwardly conducting the radially propelled water and discharging the water back in to the washing basket.

Referring to FIG. 3 for illustrating a conventional automatic washing machine, a water container 2 is mounted in a housing 1. A washing basket 3 is mounted inside the water container 2, and has an agitator 4. Mounted on the bottom of the water container 2 is a drive mechanism 5, which includes a drive motor 5*a*, and a power transfer part 5*b* for transferring the power of the drive motor 5*a* to rotate the washing basket 3 and the agitator 4.

The washing basket 3 has a water guide channel 3*a* provided in a part of the side wall. The water guide channel 3*a* has a water inlet 3*b* formed at the lower end to take in the water in the washing basket and a water outlet 3*c* formed at the upper end to discharge the water back to the inside of the washing basket, so that the water is circulated through the water guide channel 3*a*. A filter 3*d* is attached to the water outlet 3*c* to filter the water guided through the water guide channel.

When washing clothes, the drive motor 5*a* oscillates the agitator 4. Then, the water in the washing basket is radially expelled to partly flow into the water inlet 3*b* of the water guide channel 3*a*. As a result, a part of the water is circulated from the inside of the washing basket through the water guide channel 3*a*, and back to the inside of the washing basket. This operation is repeated for a programmed time. The foreign matters such as hairy materials and scraps contained in the water discharged through the water outlet 3*c* are removed by the filter 3*d*.

Although such conventional washing machine is considerably effective in a washing operation, it suffers a drawback in that the water flowing into the water guide channel cannot be discharged through the water outlet during either a low or medium water level washing mode, thereby preventing the benefits of the water guide channel from being realized.

SUMMARY OF THE INVENTION

It is an object of the present invention to provide a washing machine with means for discharging the water in the guide channel into the washing basket even in the lower or medium water level mode.

According to an embodiment of the present invention, an automatic clothes washing machine comprises:

a water container enclosed in a housing for containing water;

a washing basket mounted inside the water container to rotate about a vertical axis, the washing basket having a bottom and a side wall;

an agitator having a plurality of radial vanes for rotating about the vertical axis to radially expel the water, the agitator being arranged over the bottom;

at least a vertical channel means arranged on the inside of the side wall of the washing basket for guiding and discharging the water along the vertical length of the side wall into the washing basket; and a drive means for rotating said washing basket and the agitator, wherein the vertical channel means has a water inlet at the lower end, an uppermost water outlet at the upper end, and a plurality of intermediate water outlets between the lower and upper ends, so that the water radially expelled may come into the water inlet to be discharged through the uppermost or intermediate water outlets into the washing basket, and a filter attached to at least one of the water outlets for filtering the discharged water to remove hairy materials, scraps, etc.

The present invention will now be described with reference to the drawings attached only by way of example.

BRIEF DESCRIPTION OF THE ATTACHED DRAWINGS

DETAILED DESCRIPTION OF A PREFERRED EMBODIMENT

Figure 1:
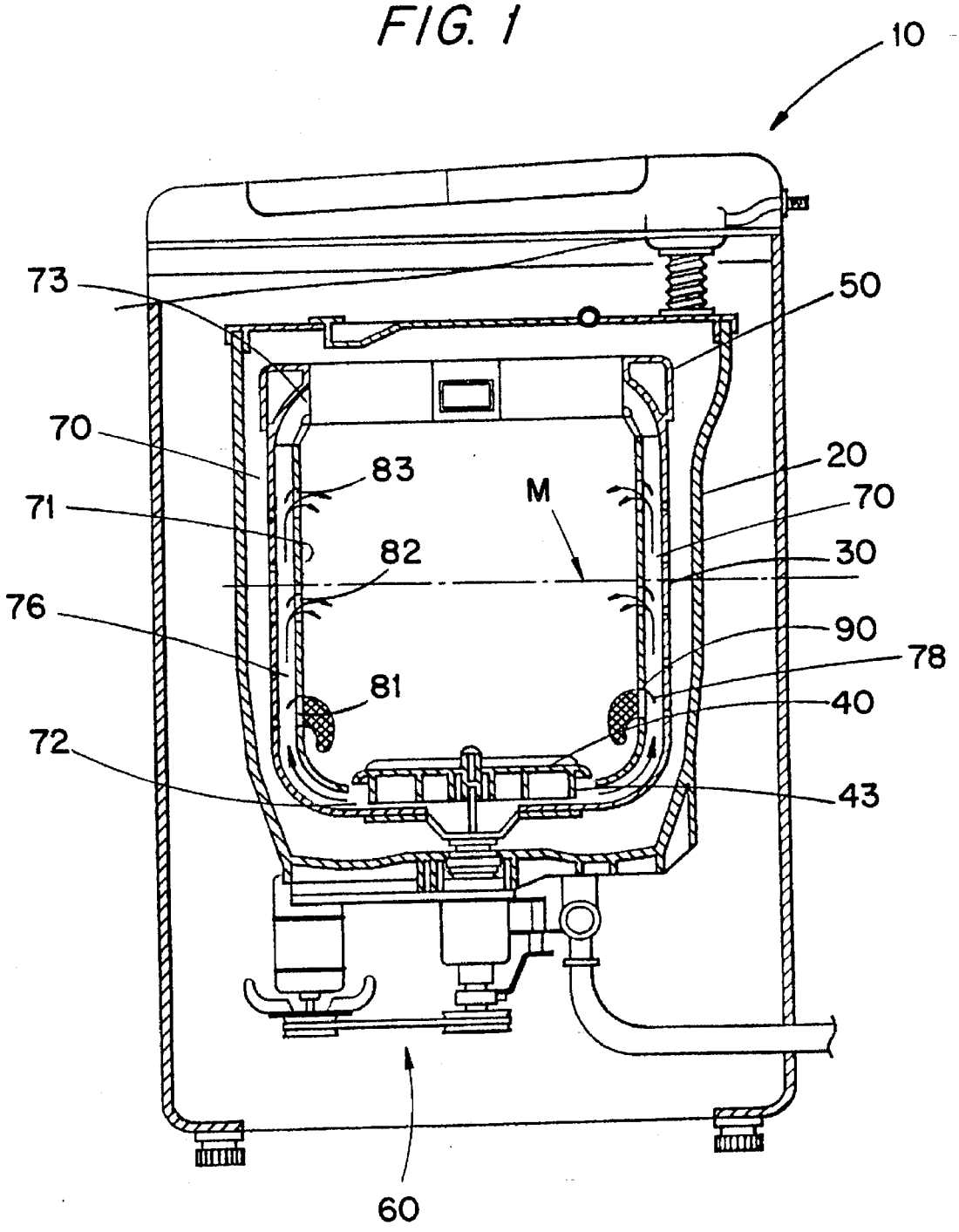
FIG. 1 is a cross sectional view for illustrating the structure of a washing machine according to the present invention.

Referring to FIG. 1, mounted in a housing 10 is a water container 20 for containing water, and a washing basket 30 with an agitator 40 disposed inside the water container. The washing basket 30 has a bottom and a side wall. Along the upper end of the washing basket 30 there is provided a liquid balance device 50 to prevent the washing basket from vibrating in operation. A power transfer mechanism 60 is mounted on the bottom of the water container 20.

At least one vertical channel 70 is arranged on the inside of the side wall of the washing basket 30 for guiding and discharging the water expelled radially outward by the agitator 40 at different levels along the vertical length of the side wall into the washing basket.

Figure 2:
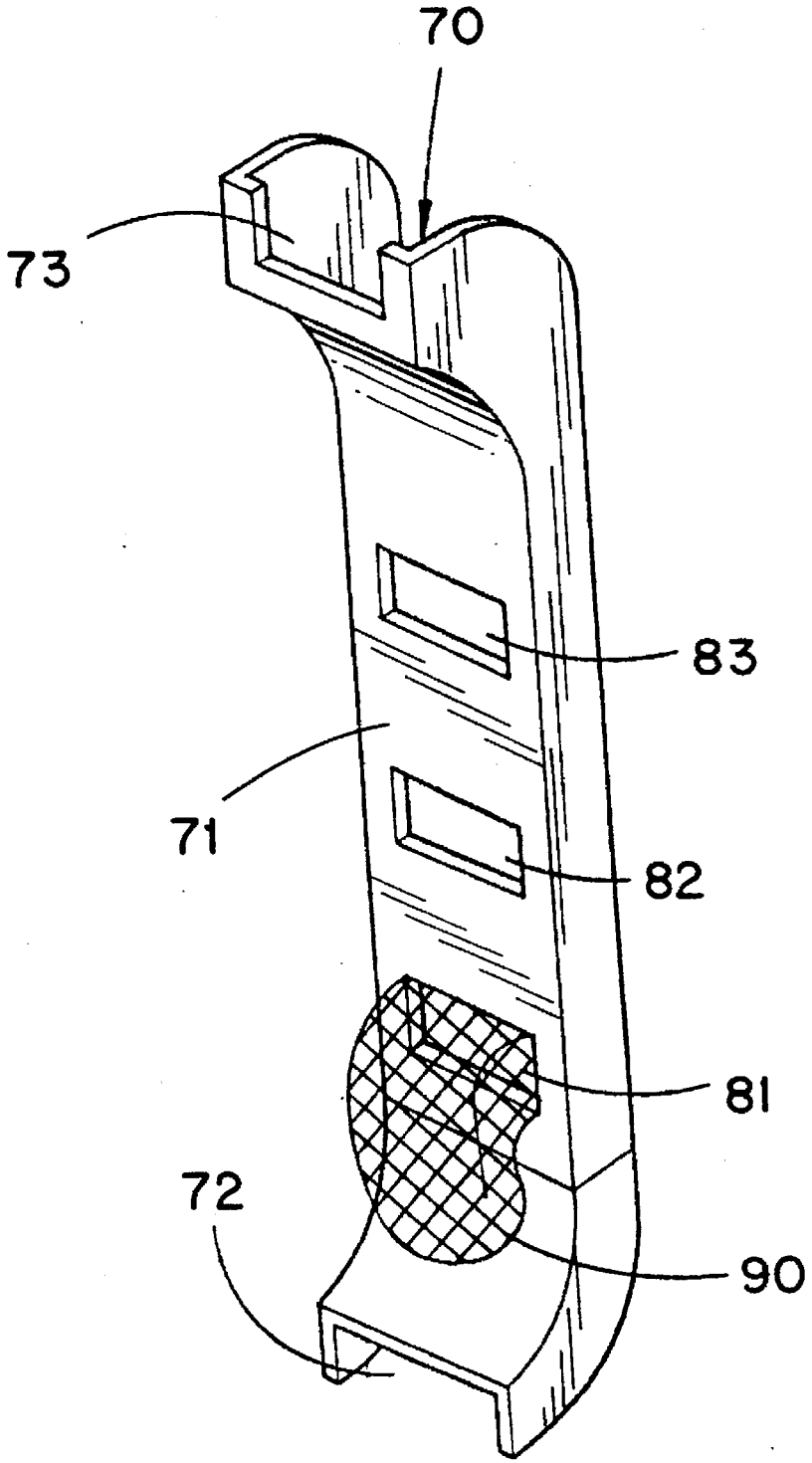
FIG. 2 is a perspective view of the essential part of the inventive washing machine.
Figure 3:
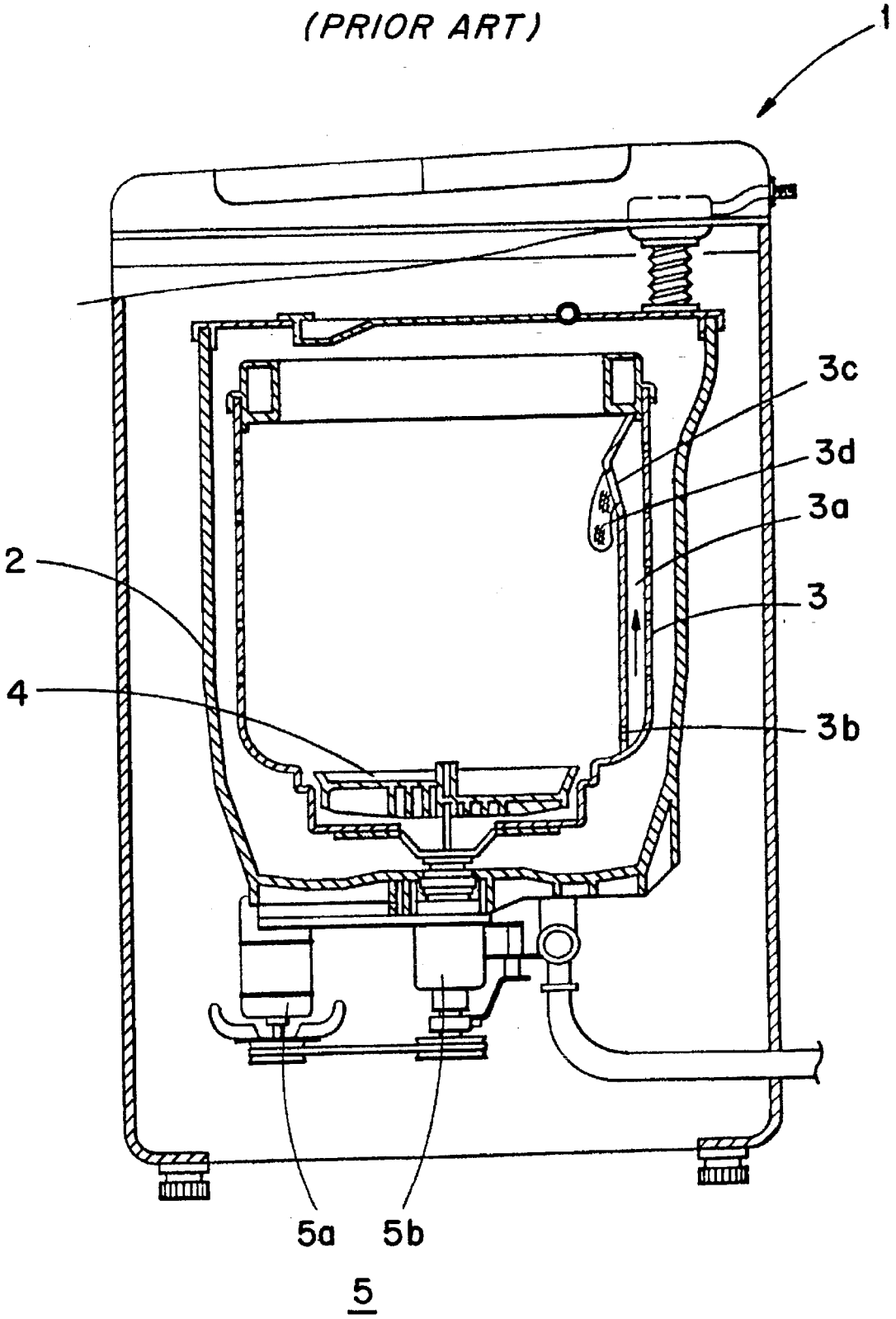
FIG. 3 (PRIOR ART)
FIG. 3 is a cross sectional view for illustrating a conventional automatic washing machine.

Referring to FIG. 2, the vertical channel 70 extends upwardly from the periphery of the agitator 40 to a position beneath the liquid balance device 50 so as to form a hollow space 76 by means of a guide member 71. The vertical channel 70 includes a water inlet 72 at the lower end and an uppermost water outlet 73 at the upper end. It is preferable to arrange a plurality of the guide members 71 along the inside of the washing basket 30. The water inlet 72 and the water outlet 73 are preferably curved toward the central axis of the washing basket. Two of the water outlets 81 and 92 are disposed below a plane M defining a vertical midpoint of each channel.

The guide channel 70 has an ejecting structure which causes the water flowing into the water inlet 72 by the rotation of the agitator 40 alternately in the opposite directions to be discharged back into the washing basket at different levels. The ejecting structure comprises a plurality of intermediate water outlets 81, 82, 83 formed at different levels between the lower and upper ends of the guide member 71. Each of the intermediate water outlets 81, 82, 83 has a guide vane 78 formed in the hollow space 76 to cause the water flowing into the hollow space to be discharged back into the washing basket 30. It is preferable to detachably attach a filter 90 to at least one of the outlets.

In operation, the amount of the water supplied to the washing basket 30 depends on the volume of clothes. For example, when washing a small volume of clothes, the water is supplied at the level of the lowest water outlet 81 of the guide member 71. In this state, the power transfer mechanism 60 rotates the agitator 40 alternately in the opposite directions. The agitator has a plurality of radial vanes 43 rotating about the central axis, which radially expel the water, so that a part of the water is driven into the guide channel 70 through the water inlet 72 and the remaining water is agitated to rotate the clothes alternately in the opposite directions in the washing basket.

The water driven into the hollow space 76 of the guide channel 70 is guided by the guide vane 78 is forcefully discharged through the water outlet 81 into the washing basket 30, thus striking at the immersed clothes being moved upwards by the rotation of the agitator. In addition, the discharged water is filtered through a filter 90 to remove hairy materials, scraps, etc.

Likewise, when the volume of the clothes is at medium, the water is supplied at the level of the water outlet 82, so that the water flowing into the hollow space is discharged through two outlets 81 and 82 enhancing the washing effect. Further, when the volume of the clothes is at maximum, the water is supplied at the level of the uppermost water outlet 83, so that the water is discharged through all the intermediate water outlets 81, 82 and 83 for further enhancing the washing effect.

Thus, a part of the water in the washing basket is always discharged through the guide channel back into the washing basket regardless of the water levels, i.e., high, medium and low levels, striking at the clothes so as to fully immerse them into the water of the washing basket, and increasing the disturbance of the water.

What is claimed is:

1. An automatic clothes washing machine comprising:

a water container enclosed in a housing for containing water;

a washing basket mounted inside said water container to rotate about a vertical axis, said washing basket having a bottom and a side wall;

a driven agitator having a plurality of radial vanes for rotating about said vertical axis to radially outwardly propel said water, said agitator being arranged over said bottom; and at least one vertical water-guiding channel arranged on the inside of said side wall of said washing basket, said channel including a water inlet at its lower end for receiving the radially propelled water, a plurality of vertically spaced water outlets disposed above said water inlet for discharging water into said washing basket, and a filter mounted at at least one of said water outlets for filtering the water discharged therefrom, wherein at least one of said water outlets is situated below a vertical midpoint of said water-guiding channel, said washing machine being operable to fill said washing basket with water at low, medium, and maximum levels, there being a said water outlet adjacent each of said levels.

2. The clothes washing machine according to claim 1 wherein two of said water outlets are situated below said vertical midpoint.

3. The clothes washing machine according to claim 1 wherein there is a plurality of said water-guiding channels spaced apart circumferentially with respect to said vertical axis.

4. The clothes washing machine according to claim 1 wherein said filter is mounted at a lowest one of said water outlets.

5. The clothes washing machine as defined in claim 1 wherein said water outlets include an upper water outlet disposed at an upper end of said water channel, and a plurality of vertically spaced water outlets disposed below said upper water outlet.

6. The washing machine according to claim 5, wherein there is a plurality of said water-guiding channels spaced apart circumferentially with respect to said vertical axis; said filter mounted at a lowest one of said water outlets.

* * * * *